US008807552B2

(12) United States Patent
Kondo et al.

(10) Patent No.: US 8,807,552 B2
(45) Date of Patent: Aug. 19, 2014

(54) IMAGE FORMING APPARATUS, OPTIONAL SHEET FEEDER, AND BASE PLATE MEMBER

(75) Inventors: Kazuyoshi Kondo, Osaka (JP); Yasuo Matsuyama, Hyogo (JP); Hiroshi Fujiwara, Osaka (JP); Yasuhide Ohkubo, Osaka (JP); Ippei Kimura, Osaka (JP); Toshikane Nishii, Osaka (JP); Mizuna Tanaka, Osaka (JP); Tomoyoshi Yamazaki, Osaka (JP); Haruyuki Honda, Osaka (JP); Masafumi Takahira, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 111 days.

(21) Appl. No.: 12/453,963

(22) Filed: May 28, 2009

(65) Prior Publication Data

US 2009/0302521 A1 Dec. 10, 2009

(30) Foreign Application Priority Data

Jun. 9, 2008 (JP) ..... 2008-150165

(51) Int. Cl.
*B65H 3/44* (2006.01)

(52) U.S. Cl.
USPC ..... 271/9.01

(58) Field of Classification Search
USPC ..... 271/145, 162, 164, 9.01, 9.11, 9.12, 271/9.13; 221/287, 197, 154
See application file for complete search history.

(56) References Cited

U.S. PATENT DOCUMENTS

| | | | | |
|---|---|---|---|---|
| 5,191,382 | A * | 3/1993 | Okamura et al. | 399/107 |
| 5,219,154 | A | 6/1993 | Fukube et al. | |
| 5,316,282 | A | 5/1994 | Fukube et al. | |
| 5,322,269 | A | 6/1994 | Fukube et al. | |
| 5,405,128 | A | 4/1995 | Fujiwara et al. | |
| 5,666,595 | A * | 9/1997 | Sameshima et al. | 399/110 |
| 6,691,998 | B2 * | 2/2004 | Mori | 271/9.05 |
| 6,785,502 | B2 | 8/2004 | Kondoh | |
| 7,203,445 | B2 * | 4/2007 | Uchida | 399/107 |
| 2006/0290049 | A1 | 12/2006 | Fujiwara | |
| 2007/0065201 | A1 | 3/2007 | Fujiwara et al. | |
| 2007/0110473 | A1 | 5/2007 | Kondo et al. | |
| 2007/0110475 | A1 | 5/2007 | Idehara et al. | |
| 2007/0166073 | A1 | 7/2007 | Idehara et al. | |
| 2007/0246638 | A1 | 10/2007 | Idehara et al. | |
| 2007/0285701 | A1 | 12/2007 | Ohta et al. | |
| 2008/0006166 | A1 | 1/2008 | Ohkubo et al. | |
| 2008/0007935 | A1 | 1/2008 | Kondo et al. | |
| 2008/0050146 | A1 | 2/2008 | Kita et al. | |
| 2008/0063425 | A1 | 3/2008 | Idehara et al. | |
| 2008/0075502 | A1 | 3/2008 | Tada et al. | |
| 2008/0138100 | A1 | 6/2008 | Matsuyama | |
| 2008/0226358 | A1 | 9/2008 | Hanashima et al. | |
| 2008/0253796 | A1 | 10/2008 | Idehara et al. | |

(Continued)

FOREIGN PATENT DOCUMENTS

| | | |
|---|---|---|
| JP | 03-037449 | 4/1991 |
| JP | 05-138987 | 6/1993 |

(Continued)

*Primary Examiner* — Thomas Morrison
(74) *Attorney, Agent, or Firm* — Harness, Dickey & Pierce, P.L.C.

(57) ABSTRACT

A base plate is selectively attached to a lower surface of a main body of an image forming apparatus or to an optional sheet feeder attachable to the main body.

16 Claims, 5 Drawing Sheets

(56) References Cited

U.S. PATENT DOCUMENTS

| | | | |
|---|---|---|---|
| 2008/0279585 | A1 | 11/2008 | Furuichi et al. |
| 2008/0292356 | A1 | 11/2008 | Furuichi et al. |
| 2009/0022514 | A1 | 1/2009 | Fujiwara et al. |
| 2009/0056484 | A1 | 3/2009 | Hanashima et al. |
| 2009/0074446 | A1 | 3/2009 | Idehara et al. |
| 2009/0074456 | A1 | 3/2009 | Tada et al. |
| 2009/0080937 | A1 | 3/2009 | Kita et al. |
| 2009/0110432 | A1 | 4/2009 | Idehara et al. |

FOREIGN PATENT DOCUMENTS

| | | |
|---|---|---|
| JP | 2529463 | 12/1996 |
| JP | 2001-356657 | 12/2001 |
| JP | 2005-305653 | 11/2005 |

* cited by examiner

IMAGE FORMING APPARATUS, OPTIONAL SHEET FEEDER, AND BASE PLATE MEMBER

CROSS-REFERENCE TO RELATED APPLICATIONS

The present application claims priority to and incorporates by reference the entire contents of Japanese priority document 2008-150165 filed in Japan on Jun. 9, 2008.

BACKGROUND OF THE INVENTION

1. Field of the Invention

The present invention relates to a technology for reducing noise leaking from an image forming apparatus.

2. Description of the Related Art

Image forming apparatuses such as copiers, printers, and facsimile machines internally include various noise sources. Those noise sources include motors, moving parts, sliding parts, rotating rollers and the like. Image forming apparatuses are typically placed in offices and if the noise of an image forming apparatus leaks outside of the image forming apparatus main body, it causes a nuisance to people working around it.

Particularly in recent years, with an intention of downsizing offices or enhancing efficiency of a business, sometimes desktop image forming apparatuses are arranged on tables close to office employees. Due to this, measures need to be taken to reduce the noise leaking from the image forming apparatus main body.

Some image forming apparatuses include a plurality of sheet feeders right from the beginning. In these image forming apparatuses, various types of recording sheets can be stacked in the sheet feeders and selectively used. However, some users do not need a plurality of sheet feeders and for them the image forming apparatus with a plurality of sheet feeders is unnecessary costly.

Image forming apparatuses are available in which only one, or two, sheet feeders are provided right from the beginning; and one or more sheet feeders can be added at a later stage. A lower surface of such an image forming apparatus has an opening that leads to a sheet feeding path of the optional sheet feeder. However, noise produced in the image forming apparatus main body leaks to the outside from this opening and from a gap between the lower surface and the installation surface.

Related arts have been disclosed in Japanese Patent Application Laid-open No. 2001-356657, Japanese Patent Application Laid-open No. 2005-305653, Japanese utility model application Laid-open No. H3-093130, Japanese utility model application Laid-open No. H3-037449, and Japanese utility model application Laid-open No. H5-138987. In Japanese Patent Application Laid-open No. 2001-356657, a special member is used to seal the gap between the lower surface of the image forming apparatus and the installation surface. In Japanese Patent Application Laid-open No. 2005-305653, Japanese utility model application Laid-open No. H3-093130, Japanese utility model application Laid-open No. H3-037449, and Japanese utility model application Laid-open No. H5-138987, a special sound insulating member is arranged between the lower surface of the image forming apparatus and the installation surface. Thus, a special component is required for sound insulation in the technologies mentioned earlier. For reducing the work after arrangement, one approach could be to attach an elastic member to the lower surface of the image forming apparatus and in contact with the installation surface. In this approach the opening itself is not blocked. However, for this approach to be effective, the installation surface must be substantially flat. Noise insulation effects are not obtained if the installation surface is not flat. Moreover, because the elastic member is exposed outside the image forming apparatus, damage or deformation is likely to occur when manufacturing or packing the image forming apparatus and while handling the image forming apparatus after arrangement. Thus, constant sound insulation effects cannot be obtained.

SUMMARY OF THE INVENTION

It is an object of the present invention to at least partially solve the problems in the conventional technology.

According to an aspect of the present invention, there is provided an image forming apparatus including a main body; a sheet feeder arranged in a lower part of the main body; a connecting unit for receiving a sheet from an optional sheet feeder; and a main-body-side coupling unit arranged on the lower surface of the main body and to which one of the optional sheet feeder and a base plate can be selectively coupled.

According to another aspect of the present invention, there is provided an optional sheet feeder that can be coupled to a lower side of a main body of an image forming apparatus. The optional sheet feeder including a connecting unit for receiving a sheet from an additional optional sheet feeder; and an optional-sheet-feeder-side coupling unit arranged on the lower surface of the optional sheet feeder and to which one of the additional optional sheet feeder and a base plate can be selectively coupled.

According to another aspect of the present invention, there is provided a base plate member attachable to a lower surface of a main body of an image forming apparatus or to a lower surface of an optional sheet feeder attachable to the main body. The base plate member includes a base-plate-side coupling unit that can be coupled to the lower surface of the main body or to the lower surface of the optional sheet feeder.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are explained in detail below with reference to the accompanying drawings.

Figure 1A:
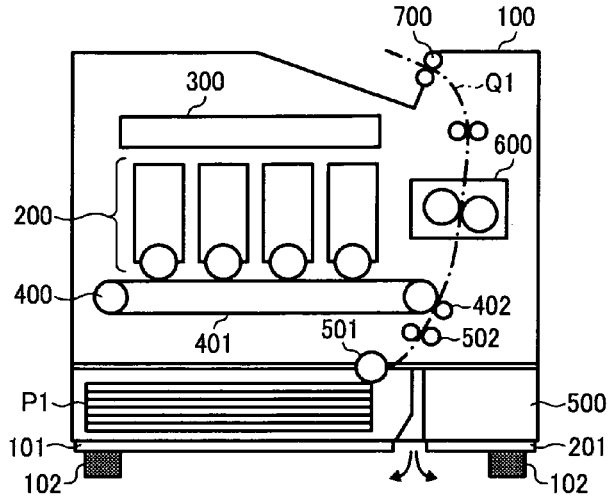
FIG. 1A is a schematic diagram for explaining a structure of a laser printer that is an example of an image forming apparatus according to an embodiment of the present invention.

FIG. 1A is a schematic diagram for explaining a structure of a laser printer that is an example of an image forming apparatus according to an aspect of the present invention. As shown in FIG. 1A, a main body 100 of the image forming apparatus includes a developing unit that develops an electrostatic latent image by centering on an image carrying member (photosensitive drum) that forms the electrostatic latent image, a toner housing unit, a mechanism required for other electrophotographic processes, and an image forming unit that includes a plurality of process cartridges 200 that are integrally arranged for each color of black, cyan, magenta, and yellow (K, C, M, Y) and an exposure device 300 that forms the electrostatic latent image on the image carrying member. The latent images are transferred in a superimposed manner onto an endless transfer belt 401 at a transfer device 400.

A sheet feeder 500 is arranged in the main body 100 of the image forming apparatus. Sheets P1 of a particular size or type are stacked in the sheet feeder 500. A topmost sheet P1 is picked by a sheet feeding roller 501 and fed between a pair of transfer rollers 402 via a pair of registration rollers 502. When the sheet P1 passes between the transfer rollers 402, an image from the transfer belt 401 is transferred onto the sheet P1. The sheet P1 is then conveyed to a fixing device 600 that fixes the image onto the sheet P1. Finally, the sheet P1 is discharged by a sheet discharging device 700 into a discharge tray. A feeding path of the sheet P1 is denoted by a dashed-dotted line Q1 that is a moving path of the sheet.

Figure 1B:
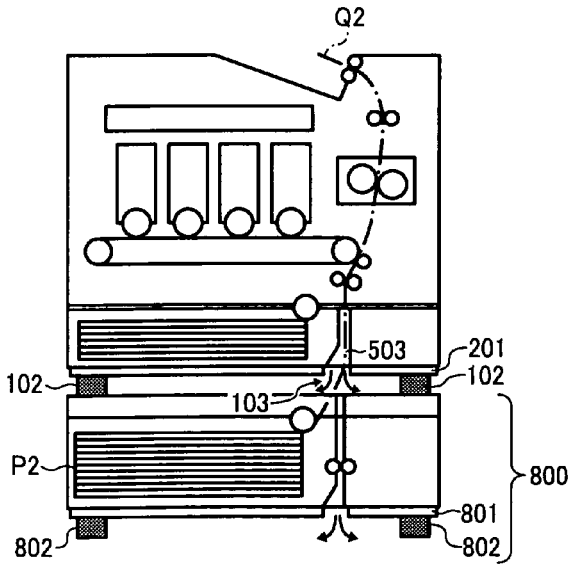
FIG. 1B is a schematic diagram of the image forming apparatus to which an optional sheet feeder is coupled.

FIG. 1B is a schematic diagram of the image forming apparatus to which an optional sheet feeder 800 is coupled. A base plate 201 is fixed to a lower surface of the main body 100. A plurality of supporting legs 102 is fixed to a lower surface of the base plate 201. The optional sheet feeder 800 is coupled to a lower surface of the main body 100 and sheets P2 of a particular size or type are stacked in the optional sheet feeder 800. A topmost sheet P2 is picked from the optional sheet feeder 800 and fed to the main body 100 of the image forming apparatus through an opening 103 in the base plate 201 and through the sheet feeder 500. The sheet P2 first passes along a sheet feeding path 503 provided in the sheet feeder 500 and then passes along the feeding path denoted by a dashed-dotted line Q2 within the main body 100. Image formation is carried out on the sheet P2 in the same manner as explained with reference to FIG. 1A.

Figure 1C:
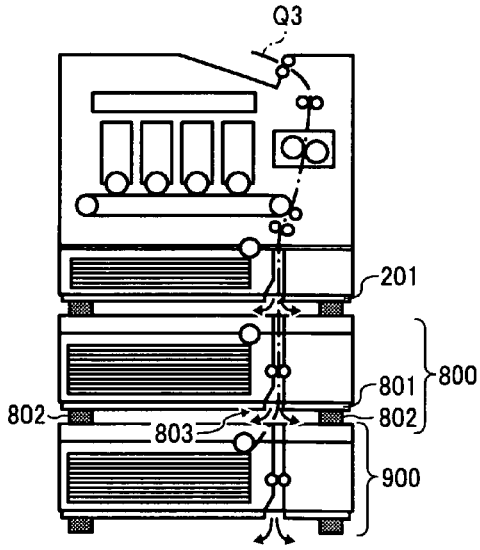
FIG. 1C is a schematic diagram of the image forming apparatus to which two optional sheet feeders are coupled.

FIG. 1C is a schematic diagram of the image forming apparatus to which two optional sheet feeders 800 and 900 are coupled. In the same manner as explained with reference to FIG. 1B, a base plate is fixed to a lower surface of the optional sheet feeder 900 and a plurality of supporting legs is fixed to a lower surface of the base plate. A topmost sheet first is fed from the optional sheet feeder 900 to the optional sheet feeder 800 through an opening 803 in the base plate 801 and then it enters into the main body 100 of the image forming apparatus. The sheet then passes along the feeding path denoted by a dashed-dotted line Q3 within the main body 100. Image formation is carried out on the sheet in the same manner as explained with reference to FIG. 1A.

Figure 2:
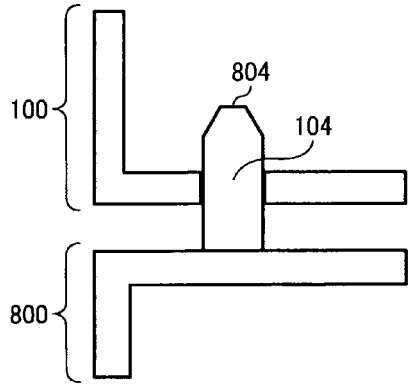
FIG. 2 is a schematic diagram for explaining a coupling structure for coupling the optional sheet feeder to the image forming apparatus.

FIG. 2 is a schematic diagram for explaining a coupling structure 104 for coupling the main body 100 and the optional sheet feeder 800. A positioning pin 804 is arranged on an upper surface of the optional sheet feeder 800. The positioning pin 804 is inserted into the coupling structure 104 that is arranged in the main body 100 of the image forming apparatus. Due to this, the main body 100 and the optional sheet feeder 800 are position-controlled.

Thus, in the image forming apparatus having the structure mentioned earlier, an operating sound of the image forming apparatus, such as a sheet feeding sound emitted from the openings 103 and 803 of the respective base plates 201 and 801, is emitted from the gap between the bottom face of the image forming apparatus and the installation surface.

In contrast, in the image forming apparatus according to an embodiment of the present invention, a coupling structure similar to the coupling structure 104, which is provided in the optional sheet feeder 800, is provided in a base plate 101 and the coupling structure 104 of the optional sheet feeder 800, which is provided in the main body 100 of the image forming apparatus, is commonly used. When no optional sheet feeder is coupled to the main body 100, the base plate 101 is attached to the main body 100. When the optional sheet feeder 800 is coupled to the main body 100, the base plate 101 is attached to the optional sheet feeder 800. When the optional sheet feeder 900 is coupled to optional sheet feeder 800, the base plate 101 is attached to the optional sheet feeder 900.

Figure 3A:
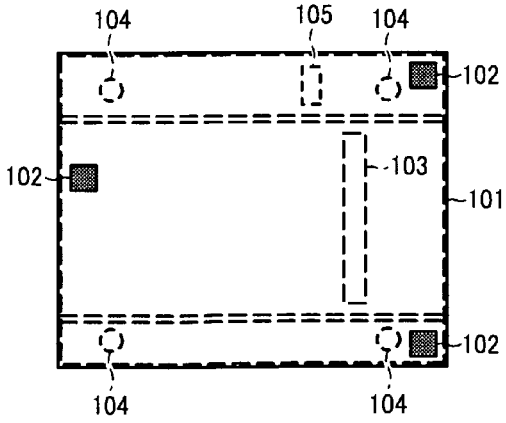
FIG. 3A is a bottom view of a base plate attached to a main body of the image forming apparatus.
Figure 3B:
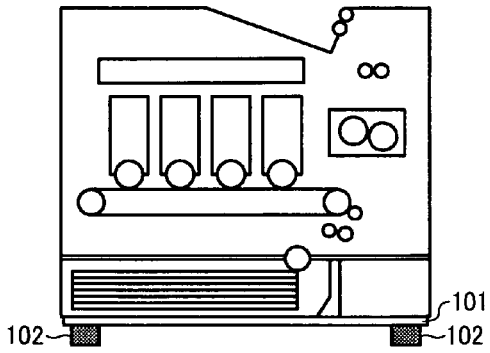
FIG. 3B is a side view of the main body of the image forming apparatus with the base plate attached thereto.

FIG. 3A is a bottom view of the base plate 101 and FIG. 3B is a side view of the main body 100 to which the base plate 101 is attached. As shown in FIG. 3A, the positioning pin 804 that is provided in the optional sheet feeder 800 is fitted into the coupling structure 104 provided in the main body 100. Thus, the base plate 101 can be arranged at a suitable position at which the base plate 101 can seal the opening 103 in the main body 100. Because the supporting legs 102 are fixed to the base plate 101, the base plate 101 can be firmly attached to the lower surface due to a self-weight of the main body 100 of the image forming apparatus. Due to this, the sheet feeding sound can not leak from the opening 103. Moreover, a connecting unit 105 that electrically communicates with the optional sheet feeder 800 can also be protected.

Figure 4A:
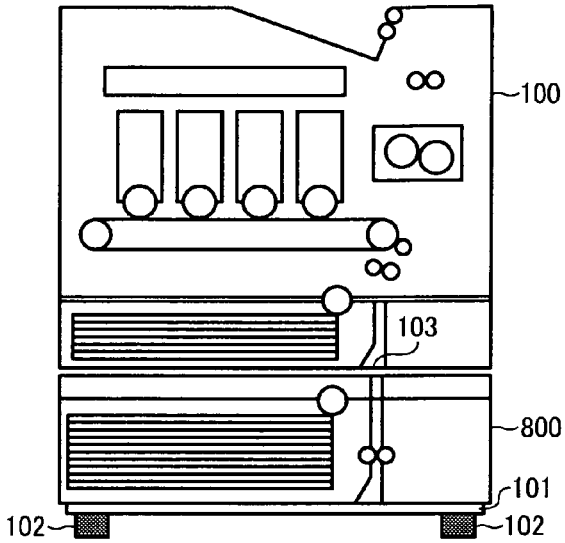
FIGS. 4A and 4B are side views of the image forming apparatus when the base plate is attached to the optional sheet feeder and not to the main body.
Figure 4B:
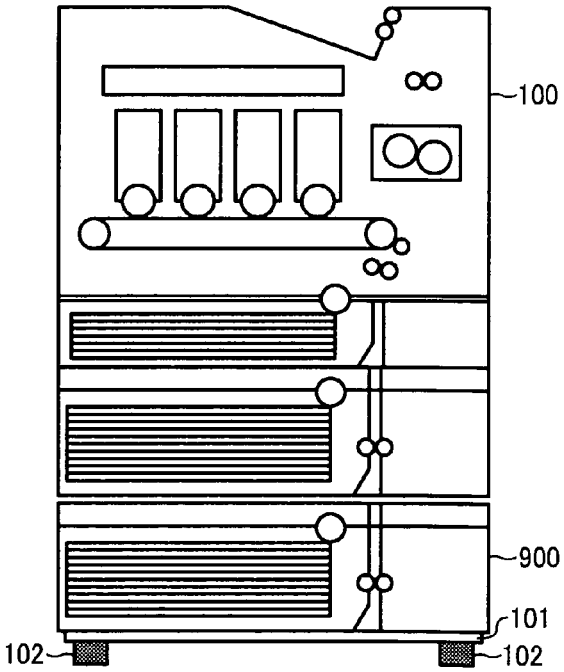

As shown in FIGS. 4A and 4B, when the optional sheet feeder 800 is coupled to the lower surface of the main body 100, only the main body 100 is first moved. Subsequently, for coupling the additional optional sheet feeder 900 to the optional sheet feeder 800, because a coupling structure is provided in the optional sheet feeder 800 similarly as the coupling structure 104 provided in the main body 100, the base plate 101 is attached to the optional sheet feeder 900. Thus, the sheet feeding sound can not leak from the openings 103 and 803. Furthermore, by coupling the main body 100 of the image forming apparatus to the upper surface of the optional sheet feeder 800, the upper surface of the optional sheet feeder 800 can be firmly attached to the lower surface of the main body 100. Due to this, the sheet feeding sound can not leak from the opening 103. When arranging the optional sheet feeder 900, the sound can be insulated from the lower surface by performing operations similarly as the operations performed for the optional sheet feeder 800.

Figure 5A:
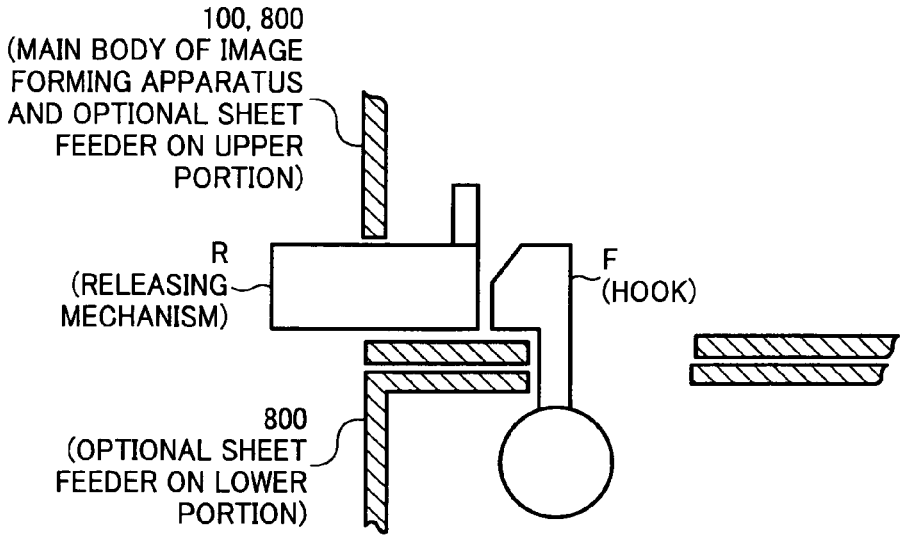
FIGS. 5A and 5B are schematic diagrams for explaining a releasing mechanism for releasing the attached base plate.
Figure 5B:
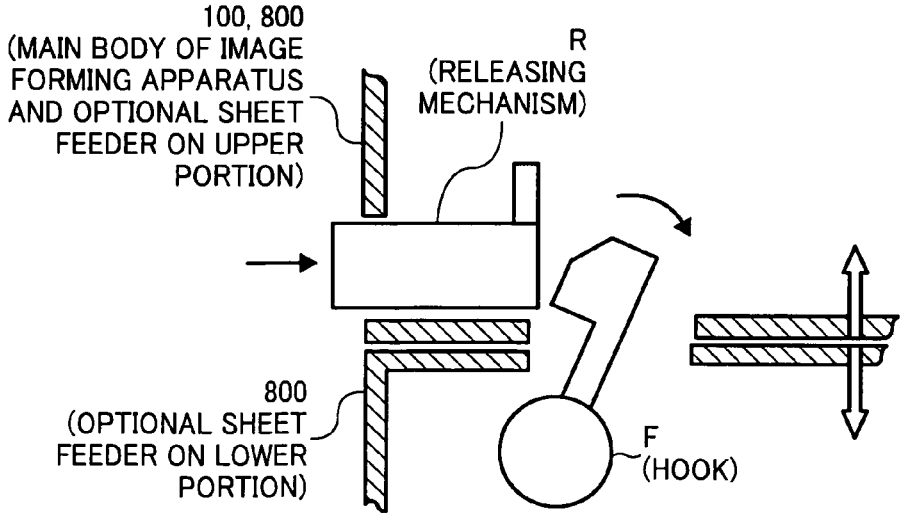

As shown in FIGS. 5A and 5B, when the base plate 101 and the optional sheet feeder 800 are likely to fall while handling the main body 100 of the image forming apparatus, a structure, which includes a releasing mechanism (a releasing body R and a hook F), can be used. Because the main body 100 or the optional sheet feeder 800, which is on an upper portion of the image forming apparatus, moves in a series of operations at the time of arrangement, it is preferable that the releasing mechanism be on the main body 100 or the optional sheet feeder 800 that is on the upper portion.

Figure 6A:
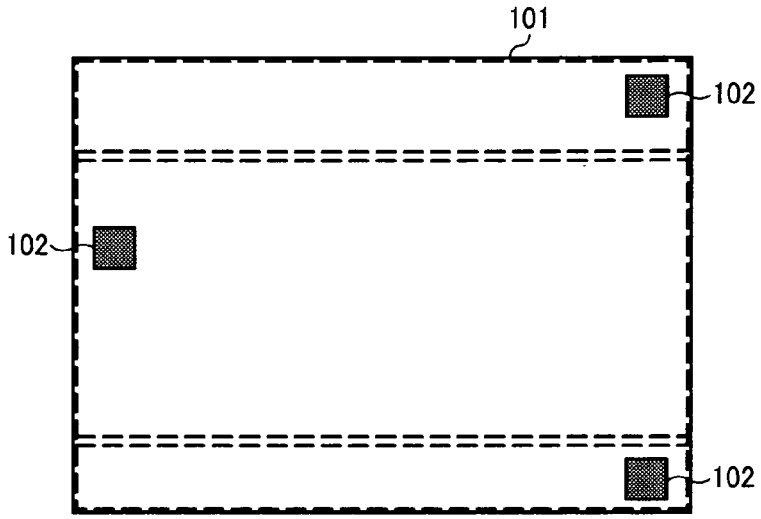
FIGS. 6A and 6B are bottom views of the base plate for explaining attachment positions of supporting legs to the base plate.
Figure 6B:
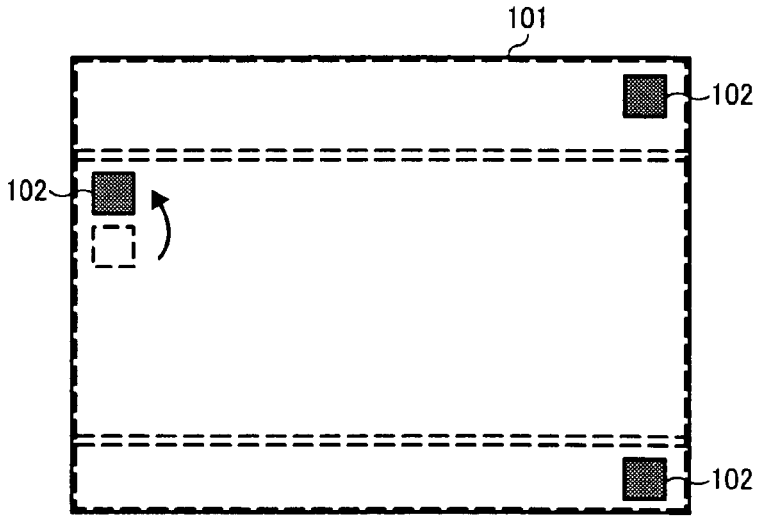

A second embodiment of the present invention is explained below specifically when multiple-stage optional sheet feeders are added. FIGS. 6A and 6B are bottom views of the base plate 101 for explaining attachment positions of the supporting legs 102 that are three in number. FIG. 6A depicts attachment positions of the three supporting legs 102 when no optional sheet feeder is coupled to the main body 100 and FIG. 6B depicts attachment positions of the three supporting legs 102 when one or more optional sheet feeders are coupled to the main body 100.

The number and weights of the components arranged inside the main body 100 and the number and weights of the components arranged inside the optional sheet feeder are different. As a result, the center of gravity of the main body 100 and the center of gravity of the optional sheet feeder can differ. The centers of gravity of the main body 100 and the optional sheet feeders can differ significantly if multiple-stage optional sheet feeders are coupled to the main body 100. Assuming that an attachment position of the supporting legs 102 is set with respect to the main body 100 of the image forming apparatus, the main body 100 can be stably supported when the main body 100 is only a basic unit. However, when the image forming apparatus includes the optional sheet feeders, the image forming apparatus cannot be stably supported on the installation surface.

Thus, in the second embodiment, as shown in FIGS. 6A and 6B, the attachment positions of one or more of the three supporting legs 102 is changed based on whether the optional sheet feeder 800 or 900 is coupled to the main body 100. This arrangement enables to stably support the image forming apparatus on the installation surface even when the main body 100 is used exclusively or when the image forming apparatus includes the multiple-stage optional sheet feeders.

In other words, according to the present invention, without using a special component, the noise can be reduced by insulating noise energy that is leaked from a back-surface opening of the image forming apparatus. Moreover, when an optional sheet feeder is added, the opening can be easily opened in a series of procedures for arrangement. Thus, because a base plate member firmly attaches to the lower surface of the image forming apparatus at the suitable position, the noise can be reduced by insulating the noise energy that is leaked from the opening and the opening can be easily opened in the series of procedures for arrangement when the optional sheet feeder is added.

Because the base plate can be easily removed from the image forming apparatus, exchangeability of the base plate member can be enhanced at the time of arranging the optional sheet feeder. Because the base plate member, which includes an attachable coupling unit, is coupled to the lower surface of the main body, or the optional sheet feeder, the common base plate can firmly attached to the lower surface of the optional sheet feeder when providing the optional sheet feeder. Thus, the noise can be reduced by insulating the noise energy that is leaked from the lower surface opening of the optional sheet feeder. The image forming apparatus can be stably supported on the installation surface at any center of gravity position due to an optional structure of the image forming apparatus.

Without using any special component, the noise can be reduced by insulating the noise energy that is leaked from the lower surface opening of the image forming apparatus. When the optional sheet feeder is added, the opening can be easily opened in the series of procedures for arrangement. Thus, because the base plate member firmly attaches to the lower surface of the optional sheet feeder at the suitable position, the noise can be reduced by insulating the noise energy that is leaked from the opening. Moreover, the opening can be easily opened in the series of procedures for arrangement when an additional optional sheet feeder is added.

By arranging the common releasing mechanism that can easily remove the additional optional sheet feeder and the base plate member from the optional sheet feeder, exchangeability of the base plate member can be enhanced. By closely attaching the common base plate member to the lower surface of the optional sheet feeder or the lower surface of the additional optional sheet feeder, the noise is reduced by insulating the noise energy that is leaked from the opening. Because the base plate member, which includes the attachable coupling unit, is coupled to the lower surface of the optional sheet feeder or the additional optional sheet feeder, the common base plate can firmly attach to the lower surface of the additional optional sheet feeder when providing the additional optional sheet feeder. Therefore, the noise can be reduced by insulating the noise energy that is leaked from the lower surface opening of the additional optional sheet feeder.

The attachment positions of supporting legs attached to the base plate can be changed. Due to this, the image forming apparatus can be stably supported on the installation surface at any center of gravity position due to the optional structure of the image forming apparatus.

The noise can be reduced by insulating the noise energy that is leaked from the opening by closely attaching the base plate to any of the lower surface of the image forming apparatus, the lower surface of the optional sheet feeder, and the lower surface of the additional optional sheet feeder. Thus, the image forming apparatus can be stably supported on the installation surface at any center of gravity position due to the optional structure of the image forming apparatus. By selecting the attachment positions of the supporting legs attached to the base plate, the image forming apparatus can be stably supported on the installation surface at any center of gravity position due to the optional structure of the image forming apparatus.

A process cartridge according to a third embodiment of the present invention is made of stainless used steel (SUS).

According to an aspect of the present invention, noise leaking from an image forming apparatus can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a main body having a bottom surface thereof;

a sheet feeder arranged in a lower part of the main body;

a connecting unit attachable to the main body for receiving an optional sheet feeder having a bottom surface thereof;

a base plate attachable to the bottom surface of the main body including the sheet feeder or to the bottom surface of the optional sheet feeder depending on which of the main body or the optional sheet feeder is the bottommost device, an upper surface of the base plate is flat conforming to the bottom surface of the main body or to the bottom surface of the optional sheet feeder;

a main-body-side coupling unit arranged on the bottom surface of the main body; and an optional-sheet-feeder-side coupling unit arranged on the bottom surface of the optional sheet feeder, wherein the base plate includes a base-plate-side coupling unit that can be selectively coupled to the main-body-side coupling unit or to the optional-sheet-feeder-side coupling unit, wherein, on the upper surface of the base plate, an opposing portion opposed to an opening of a sheet feeding path of the main body or the optional sheet feeder is formed, the opposing portion is in contact with the bottom surface of the main body or the bottom surface of the optional sheet feeder caused by self-weight of the main body or the optional sheet feeder, and due to the contact of the main body or the optional sheet feeder, the opposing portion seals the opening of the sheet feeding path of the main body or the optional sheet feeder, and wherein the base plate includes one or more supporting legs on a lower surface thereof, and an attachment position of at least one of the supporting legs is adjustable.

2. The image forming apparatus according to claim 1, wherein the main body includes a releasing mechanism to release the base plate or the optional sheet feeder coupled to the main-body-side coupling unit.

3. The image forming apparatus according to claim 1, wherein the upper surface of the base plate extending across an entire width thereof is flat.

4. The image forming apparatus according to claim 1, further comprising:

an additional optional sheet feeder; and a releasing mechanism disposed in the main body and extends out from one side of the main body to be pushed inwardly therein by an operator to release the base plate or the additional optional sheet feeder coupled to the optional-sheet-feeder-side coupling unit.

5. An optional sheet feeder arranged to be coupled to a lower side of a main body of an image forming apparatus, the optional sheet feeder comprising:

a base plate attachable to a bottom surface of the main body of the image forming apparatus or to a bottom surface of the optional sheet feeder attachable to the main body of the image forming apparatus depending on which of the main body or the optional sheet feeder is the bottommost device, an upper surface of the base plate is flat conforming to the bottom surface of the main body or to the bottom surface of the optional sheet feeder;

a connecting unit for receiving an additional optional sheet feeder; and an optional-sheet-feeder-side coupling unit arranged on the bottom surface of the optional sheet feeder; and an additional optional-sheet-feeder side coupling unit arranged on the lower surface of the additional optional sheet feeder, wherein the base plate includes a base-plate-side coupling unit that can be selectively coupled to the optional-sheet-feeder-side coupling unit or to the additional optional-sheet-feeder side coupling unit, wherein, on the upper surface of the base plate, an opposing portion opposed to an opening of a sheet feeding path of the main body or the optional sheet feeder is formed, the opposing portion is in contact with the bottom surface of the main body or the bottom surface of the optional sheet feeder caused by self-weight of the main body or the optional sheet feeder, and due to the contact of the main body or the optional sheet feeder, the opposing portion seals the opening of the sheet feeding path of the main body or the optional sheet feeder, and wherein the base plate includes one or more supporting legs on a lower surface thereof, and an attachment position of at least one of the supporting legs is adjustable.

6. The optional sheet feeder according to claim 5, further comprising a releasing mechanism disposed in the main body and extends out from one side of the main body to be pushed inwardly therein by an operator to release the base plate or the additional optional sheet feeder coupled to the optional-sheet-feeder-side coupling unit.

7. The image forming apparatus according to claim 5, further comprising a releasing mechanism disposed in the main body and extends out from one side of the main body to be pushed inwardly therein by an operator to release the base plate or the additional optional sheet feeder coupled to the optional-sheet-feeder-side coupling unit.

8. The optional sheet feeder according to claim 5, wherein the upper surface of the base plate extending across an entire width thereof is flat.

9. A base plate attachable to a bottom surface of a main body of an image forming apparatus or to a bottom surface of an optional sheet feeder attachable to the main body, the base plate comprising:

a base-plate-side coupling unit that can be selectively coupled to a main-body-side coupling unit arranged on the bottom surface of the main body or to an optional-sheet-feeder-side coupling unit arranged on the bottom surface of the optional sheet feeder depending on which of the main body or the optional sheet feeder is the bottommost device, wherein, on an upper surface of the base plate, an opposing portion opposed to an opening of a sheet feeding path of the main body or the optional sheet feeder is formed, the opposing portion is in contact with the bottom surface of the main body or the bottom surface of the optional sheet feeder caused by self-weight of the main body or the optional sheet feeder, and due to the contact of the main body or the optional sheet feeder, the opposing portion seals the opening of the sheet feeding path of the main body or the optional sheet feeder, wherein the base plate includes one or more supporting legs on a lower surface thereof, and an attachment position of at least one of the supporting legs is adjustable, and wherein the upper surface of the base plate is flat conforming to the bottom surface of the main body or to the bottom surface of the optional sheet feeder.

10. The base plate according to claim 9, wherein the optional sheet feeder includes a positioning pin arranged on an upper surface of the optional sheet feeder.

11. The base plate according to claim 10, wherein the pin is inserted into the main-body-side coupling unit.

12. The base plate according to claim 9, wherein the upper surface of the base plate extending across an entire width thereof is flat.

13. An image forming apparatus, comprising:

a main body having a top surface, sides, and a bottom surface;

a sheet feeder arranged in a lower part of the main body;

a connecting unit attachable to the main body for receiving an optional sheet feeder having a bottom surface thereof;

a base plate attachable to the bottom surface of the main body including the sheet feeder or to the bottom surface of the optional sheet feeder depending on which of the main body or the optional sheet feeder is the bottommost device, an upper surface of the base plate is flat conforming to the bottom surface of the main body or to the bottom surface of the optional sheet feeder;

a main-body-side coupling unit arranged on the bottom surface of the main body;

an optional-sheet-feeder-side coupling unit arranged on the bottom surface of the optional sheet feeder, and a release mechanism disposed in the main body and extends out from one of the sides of the main body to be pushed inwardly therein by an operator to release the base plate or the optional sheet feeder coupled to the main body, wherein the base plate includes a base-plate-side coupling unit that can be selectively coupled to the main-body-side coupling unit or to the optional-sheet-feeder-side coupling unit, wherein, on the upper surface of the base plate, an opposing portion opposed to an opening of a sheet feeding path of the main body or the optional sheet feeder is formed, the opposing portion is in contact with the bottom surface of the main body or the bottom surface of the optional sheet feeder caused by self-weight of the main body or the optional sheet feeder, and due to the contact of the main body or the optional sheet feeder, the opposing portion seals the opening of the sheet feeding path of the main body or the optional sheet feeder, and wherein the base plate includes one or more supporting legs on a lower surface thereof, and an attachment position of at least one of the supporting legs is adjustable.

14. The image forming apparatus according to claim 13, wherein the release mechanism includes a release body and a hook.

15. The image forming apparatus according to claim 14, wherein the release body pushes against the hook to release the base plate or the optional sheet feeder coupled to the main body.

16. The image forming apparatus according to claim 13, wherein the upper surface of the base plate extending across an entire width thereof is flat.

* * * * *